US008517345B2

(12) United States Patent
Serra

(10) Patent No.: US 8,517,345 B2
(45) Date of Patent: Aug. 27, 2013

(54) SHIPBOARD WINCH WITH GUIDE VANES

(75) Inventor: Sal Serra, Spring Valley, CA (US)

(73) Assignee: United States of America, as Represented by the Secretary of the Navy, Washington, DC (US)

( * ) Notice: Subject to any disclaimer, the term of this patent is extended or adjusted under 35 U.S.C. 154(b) by 458 days.

(21) Appl. No.: 12/849,338

(22) Filed: Aug. 3, 2010

(65) Prior Publication Data

US 2013/0146827 A1 Jun. 13, 2013

(51) Int. Cl.
*B66D 1/26* (2006.01)
*B66D 3/00* (2006.01)

(52) U.S. Cl.
USPC ..... 254/278; 254/383

(58) Field of Classification Search
USPC ..... 254/278, 383; 242/397, 566, 615, 242/615.3, 157 R; 226/169, 189
IPC ..... B66D 1/26, 1/36
See application file for complete search history.

(56) References Cited

U.S. PATENT DOCUMENTS 1,659,521 A * 2/1928 Dye ..... 226/194
2,074,045 A * 3/1937 Carpenter ..... 34/120
2,348,987 A * 5/1944 Lock ..... 242/157.1
3,135,478 A * 6/1964 Hariander ..... 242/388
3,807,696 A * 4/1974 Brda ..... 254/391
3,843,094 A * 10/1974 Watts ..... 254/333
3,854,698 A * 12/1974 Ferrentino ..... 254/134.3 SC
3,927,867 A * 12/1975 Herchenroder ..... 254/313
4,634,102 A * 1/1987 Appling et al. ..... 254/278
4,706,940 A * 11/1987 Harig ..... 254/333
4,721,285 A * 1/1988 McMichael ..... 254/333
4,921,219 A * 5/1990 Ottemann et al. ..... 254/284
5,433,254 A * 7/1995 Pages ..... 139/82
6,283,453 B1 * 9/2001 Berget ..... 254/278
7,717,402 B2 * 5/2010 Mann ..... 254/326

* cited by examiner

*Primary Examiner* — Emmanuel M Marcelo
*Assistant Examiner* — Justin Stefanon
(74) *Attorney, Agent, or Firm* — Arthur K. Samora; Kyle Eppele

(57) ABSTRACT

A shipboard winch having guide vanes includes a first drum and a second drum that are mounted on a frame so that the drums contra-rotate when the winch is activated. A plurality of guide vanes is positioned between the first drum and the second drum. Each guide vane is formed with a base and a distal lip that extends outwardly from the guide vane when the guide vane is oriented horizontally. The guide vanes are further formed with a decreasing taper from a maximum width at the base to a minimum width at the distal lip. For deployment/recovery, the cable is threaded around the first drum, through the guide vanes and around the second drum in a figure eight configuration. A feedback circuit is used to control the rotational torque of the drums to maintain a constant tension on a cable as it is deployed or retrieved.

10 Claims, 6 Drawing Sheets

SHIPBOARD WINCH WITH GUIDE VANES

FEDERALLY-SPONSORED RESEARCH AND DEVELOPMENT

This invention (Navy Case No. 100249) is assigned to the United States Government and is available for licensing for commercial purposes. Licensing and technical inquires may be directed to the Office of Research and Technical Applications, Space and Naval Warfare Systems Center, Pacific, Code 72120, San Diego, Calif. 92152; voice (619) 553-2778; email T2@spawar.navy.mil.

FIELD OF THE INVENTION

The present invention pertains generally to winches. More particularly, the present invention pertains to shipboard winches for deployment or recovery of cables from a body of water without damaging the cable or sensors.

BACKGROUND OF THE INVENTION

Sometimes it is desired to deploy sensor arrays on the floor of an ocean or similar body of water. These arrays will often have structure wherein a plurality of sensors is fastened to a cable. To deploy the array, the cable is paid out from the fantail of a ship traveling at bare steerageway.

For arrays of this structure, it can be very difficult to deploy and recover the array without damaging some of the sensors, and deployment of the array via a mechanical means can prove to be challenging. This is because the tension of the cable varies due to the pitch and roll of the ship and because of the allowable bend radius of the cable at the connection points with the sensors. If the tension is too great, the cable may part. In some cases, array deployment is achieved either by tensioning the cable by hand or by not at tensioning at all. Recovery can be achieved either by hand or with the assistance of friction provided by the groove space between two tires in tandem, which are powered by a hydraulic motor. In the latter case, the cable rides over the rotating groove and tension is maintained by hand on the inboard side of the tandem of tires.

Deployment and recovery of long sections of cable by hand is extremely exhausting. The friction afforded by the tandem tire groove is often inadequate as cable that has been in the sea for some time often has gelatinous marine growth on it that causes the cable to be very slippery. Also, the tension can also often become excessive if the cable gets wedged between the tires and begins to wrap around; excessive tension risks parting of the cable or damage to the sensors as the array is being deployed or recovered. Alternatively, rollers could be used as a mechanical means for deployment or retrieval of an array. But rollers produce the equivalent of a speed bump when a sensor passes therethrough, which is also potentially very damaging to both the sensor and to the cable due to the limitations of allowable bend radius at the location where the cable connects to the sensor.

In view of the above, it is an object of the present invention to provide a shipboard winch having guide vanes for maintaining adequate spacing between multiple wraps of cable with sensors. Another object of the present invention is to provide a shipboard winch having guide vanes wherein the array cable is wrapped around two rotating drums in figure eight fashion to prevent twisting of the cable and thus prevent "hockles" while applying a controlled tension on the array of sensors for deployment of the array from the deck of a ship without damaging the array. It is yet another object of the present invention to provide a shipboard winch having guide vanes that allows for recovery of the array without damage to the array sensors. Another object of the present invention is to provide a shipboard winch that deploys and recovers cables in a manner that places a constant tension on the cable during recovery, even if the cable has become fouled with marine growth. Still another object of the present invention is to provide a winch for deploying/recovering a cable from ocean without causing twists or hockles in the array cable.

SUMMARY OF THE INVENTION

A shipboard winch having guide vanes according to several embodiments of the present invention can include a first drum and a second drum that are mounted on a frame. The first and second drums can be driven by a motor so that the drums contra-rotate when the winch is activated. A plurality of guide vanes can be positioned between the first drum and the second drum. Each guide vane can be formed with a base and a distal lip that extends outwardly from the guide vane. The guide vanes are further formed with a decreasing taper when the guide vane is viewed in top plan, from a maximum width at the vane base to a minimum width at the vane distal lip. The vanes are further formed with a curved leading edge that conforms to the shape of the drum. In some embodiments, the guide vanes can be stacked on top of each other and arranged so the leading edges of immediately adjacent guide vanes extend in opposite directions to alternately conform to the curvature the first drum engagement surface and the curvature of the second drum engagement surface.

In several embodiments, the first drum and the second drum of the winch can be formed with a smooth engagement surface to prevent damage to the sensor array cable as it is deployed and/or recovered. The winch can further include a hydraulic feedback circuit that is connected to the respective motors of both the first drum and the second drum. In response to the feedback circuit, the motors can be selectively operated to vary the rotational torque of the first drum and/or second drum to maintain a constant tension on a cable as it is deployed or retrieved.

The methods for deploying/retrieving cable from the fantail of a ship according to several embodiments can include the steps of attaching a frame to the fantail and mounting two drums to the frame. The methods can further include the steps of positioning a plurality of guide vanes between the first drum and the second drum, and threading the cable around the first drum, through the guide vanes and around the second drum in a figure eight configuration. The methods can further include the steps of contra-rotating the drums, and also varying the rotating torque of the drums during contra-rotation to ensure that a constant tension is imposed on the cable during deployment/retrieval.

BRIEF DESCRIPTION OF THE DRAWINGS

The novel features of the present invention will be best understood from the accompanying drawings, taken in conjunction with the accompanying description, in which similarly-referenced characters refer to similarly-referenced parts, and in which.

DETAILED DESCRIPTION OF THE EMBODIMENTS

Figure 1:
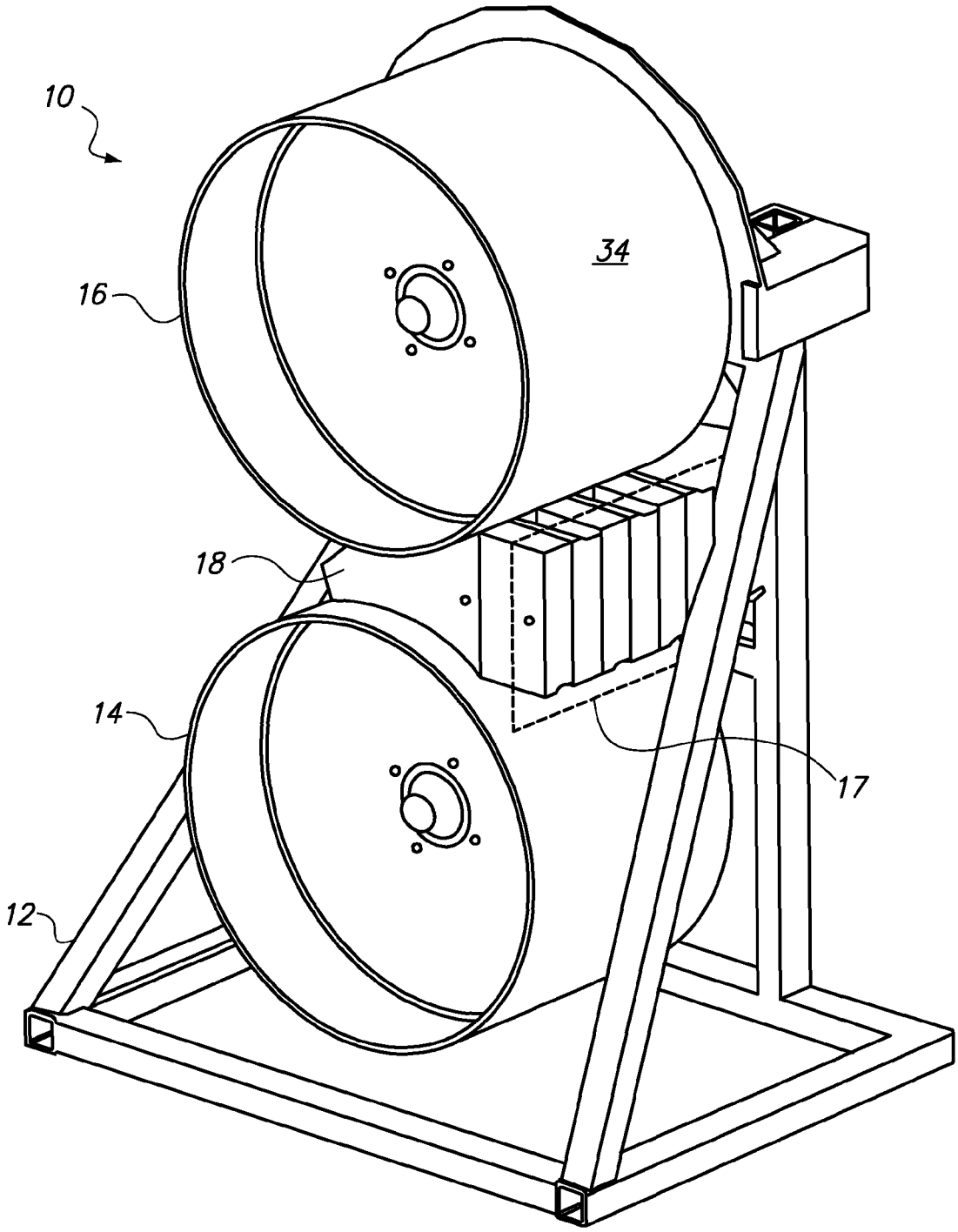
FIG. 1 is a front elevational view of a shipboard winch having guide vanes according to several embodiment of the present invention.
Figure 2:
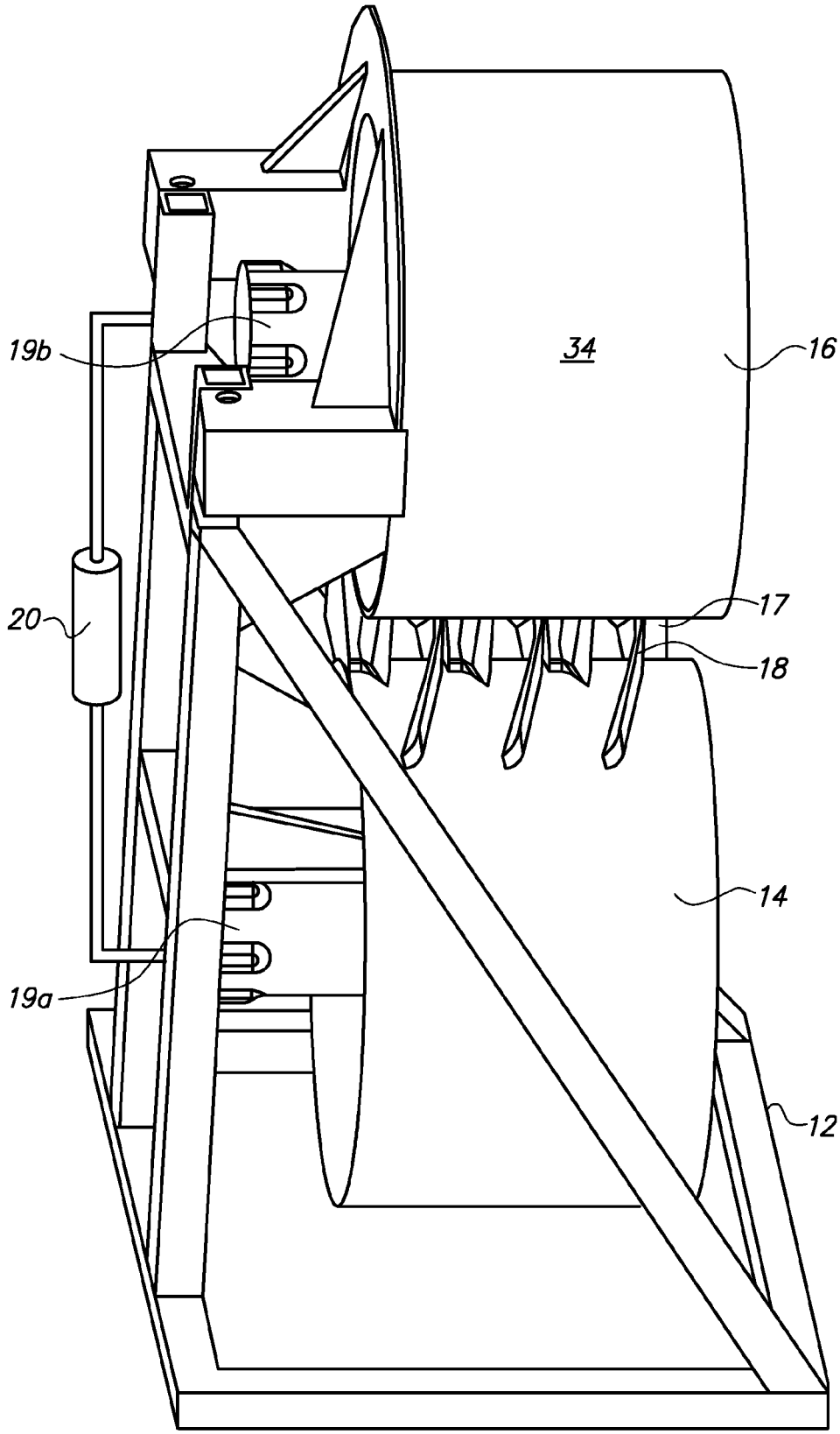
FIG. 2 is a rear elevational view of the winch of FIG. 1.
Figure 3:
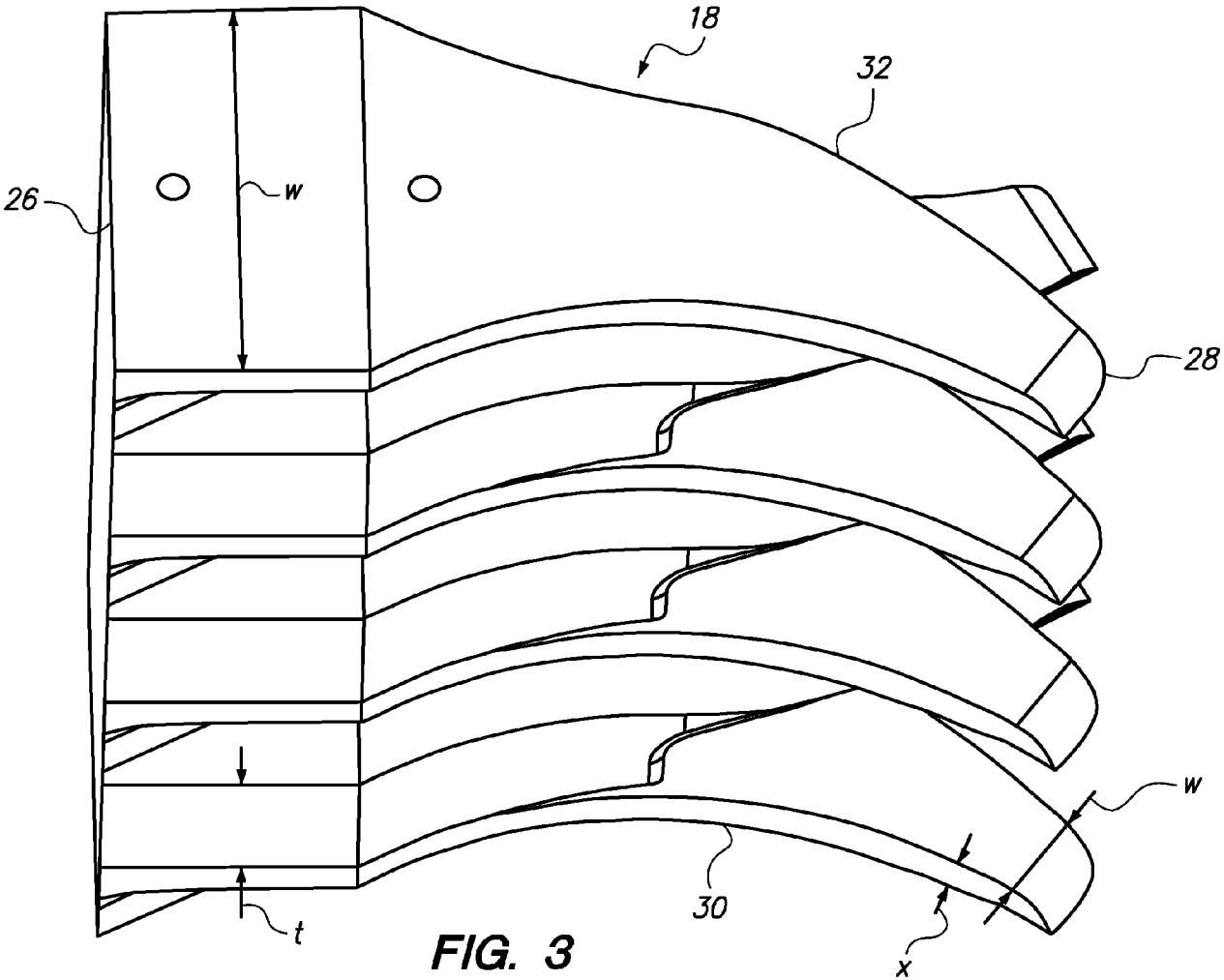
FIG. 3 is a side elevational view of several guide vanes for the winch of FIG. 1.

Referring initially to the FIGS. 1-3, a shipboard winch having guide vanes according to several embodiments of the present invention can be shown and generally designated by reference character 10. As shown, winch 10 can include a frame 12 and a first drum 14 and a second drum 16 that are mounted on frame 12. A mounting plate 17 (shown in phantom in FIG. 1 for clarity) can further be attached to frame 12, and plurality of guide vanes 18 can be attached to mounting plate 17. The guide vanes can extend at least partially between first drum 14 and second drum 16; the manner in which the guide vanes extend and the structure of the guide vanes is described more fully below. A respective hydraulic motor 19*a*, 19*b* can be attached to first drum 14 and second 16, as shown in FIG. 2.

A Hydraulic Power Unit (HPU) 20 can be plumbed through a Hydraulic Control Circuit (HCC) to rotate hydraulic motors 19*a*, 19*b* and drums 14 and 16, as shown in FIG. 2. The HCC seeks to maintain a constant though adjustable tension such that the cable and sensors are not damaged when the ship rolls and pitches with the seas. It also recovers slack developed by the ships motions. In other words, the device is constantly pulling against the cable as the ship travels on its course, usually paying out but sometimes hauling in. The function of the guide vanes is to both keep the individual wraps of cable separated and to prevent the array cable from walking off of the drums as the drums turn. The HCC is a combination of adjustable valves and other hydraulic components that in concert control the pressure and flow rate provided by the HPU and maintain the desired torque produced from the motors. One such exemplary HCC that can be used to practice several embodiments was designed and fabricated by Kent Fluid Power. Other exemplary HCC's can also be used to practice several embodiments of the present invention.

Figure 5:
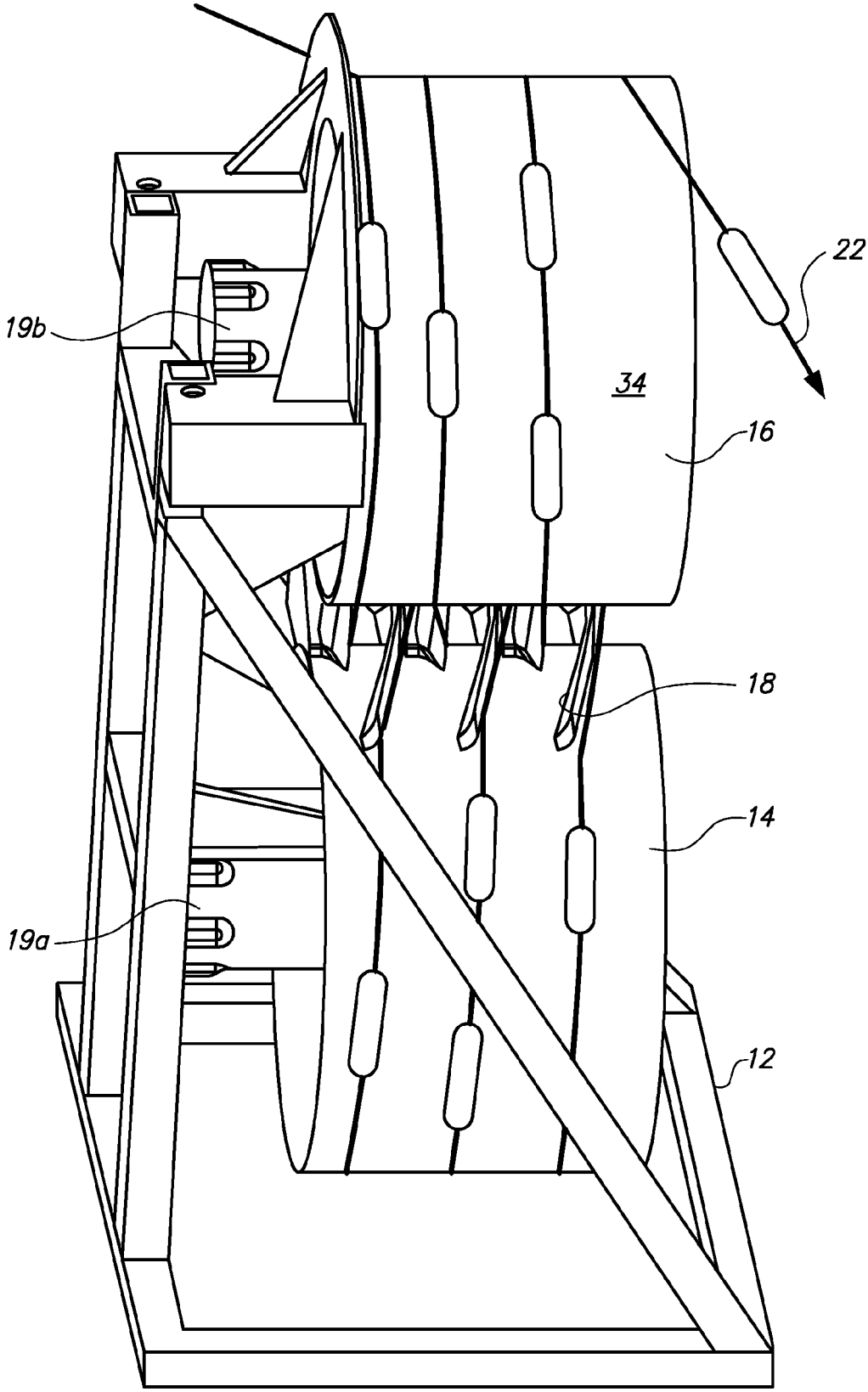
FIG. 5 is a side elevational view of the winch of FIG. 4.
Figure 6:
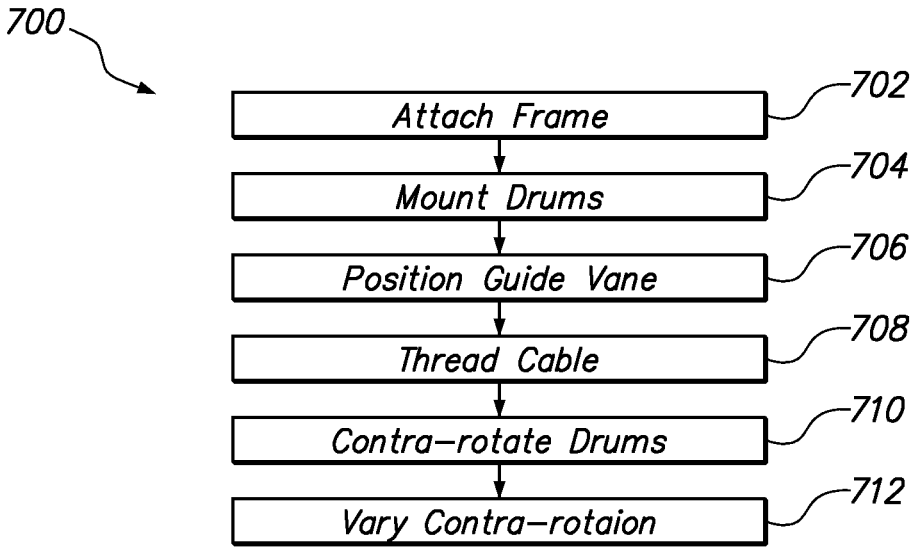
FIG. 6 is a block diagram illustrative of steps that can be taken to accomplish the methods according to several embodiments of the present invention.

In several embodiments, the cable array 22 to be deployed or recovered from the water can be wound multiple times around drums 14, 16 in a figure eight configuration, as shown in FIGS. 5-6. The reason for the multiple wraps around drums 14, 16 is to gain grip on the slick cable 22 as it wraps around the smooth engagement surface of drums 14, 16, especially during recovery from the ocean (The cable is slippery because it has become fouled with marine growth). The reason for the figure eight configuration is so not to introduce twists in the cable 22 that would cause the cable 22 to hockle or kink during deployment/recovery, thereby damaging the cable.

Referring now to FIG. 3, the structure of the guide vanes is shown in greater detail. Each guide vane 18 can extend from a base 26 to a distal lip 28. Each guide vane can be formed so that it can have a decreasing taper, from a maximum width "w" at base 26 to a minimum width "w" at distal lip 28. Additionally, the guide vanes can be formed with a maximum thickness "t" that is initially uniform at base 26 (to facilitate stacking of the vanes as described below), with the thickness decreasing to a minimum thickness "x" just before distal lip 28. The decreasing thickness allows for some flexibility in the guide vane, so that if the vanes are spaced-apart at a distance that is less than the sensor diameter, the guide vanes can flex and yield. This structure allows for cables that have sensors attached to pass through the guide vanes.

Each guide vane can further be formed with an inner leading edge 30 and an outer leading edge 32. Inner leading edge 30 has a radius of curvature that can conform to the shape of drums 14, 16. As further shown in FIG. 4 and mentioned above, the guide vanes 18 can be arranged so that they are stacked when they are fastened to mounting plate 17. When in this configuration, immediately adjacent guide vanes can extend in opposite directions, so that the inner leading edge 30 of one guide vane can conform to first drum 14, while the inner leading edge of the guide vane immediately above (and below) can conform to the shape of second drum 16.

Referring now to FIG. 6, a block diagram 700 that is illustrative of the methods that can be accomplished according to several embodiments of the present invention is shown. As shown, the methods can include the step 702 of attaching a frame to a ship; the frame can be attached to the ship proximate the fantail, or amidships. A first drum and a second drum can further be mounted to the frame, as indicated by step 704, and a plurality of guide vanes can be positioned between first drum 14 and second drum 16, as indicated by step 706 in FIG. 6. When step 706 is accomplished, the guide vanes 18 can be formed with the structure and cooperation of structure disclosed above, i.e., with the guide vanes stacked and with the leading edge of immediately adjacent guide vanes extending in alternate directions to conform to the cylindrical shape engagement surfaces 34 of the first drum and of the second drum, respectively.

Figure 4:
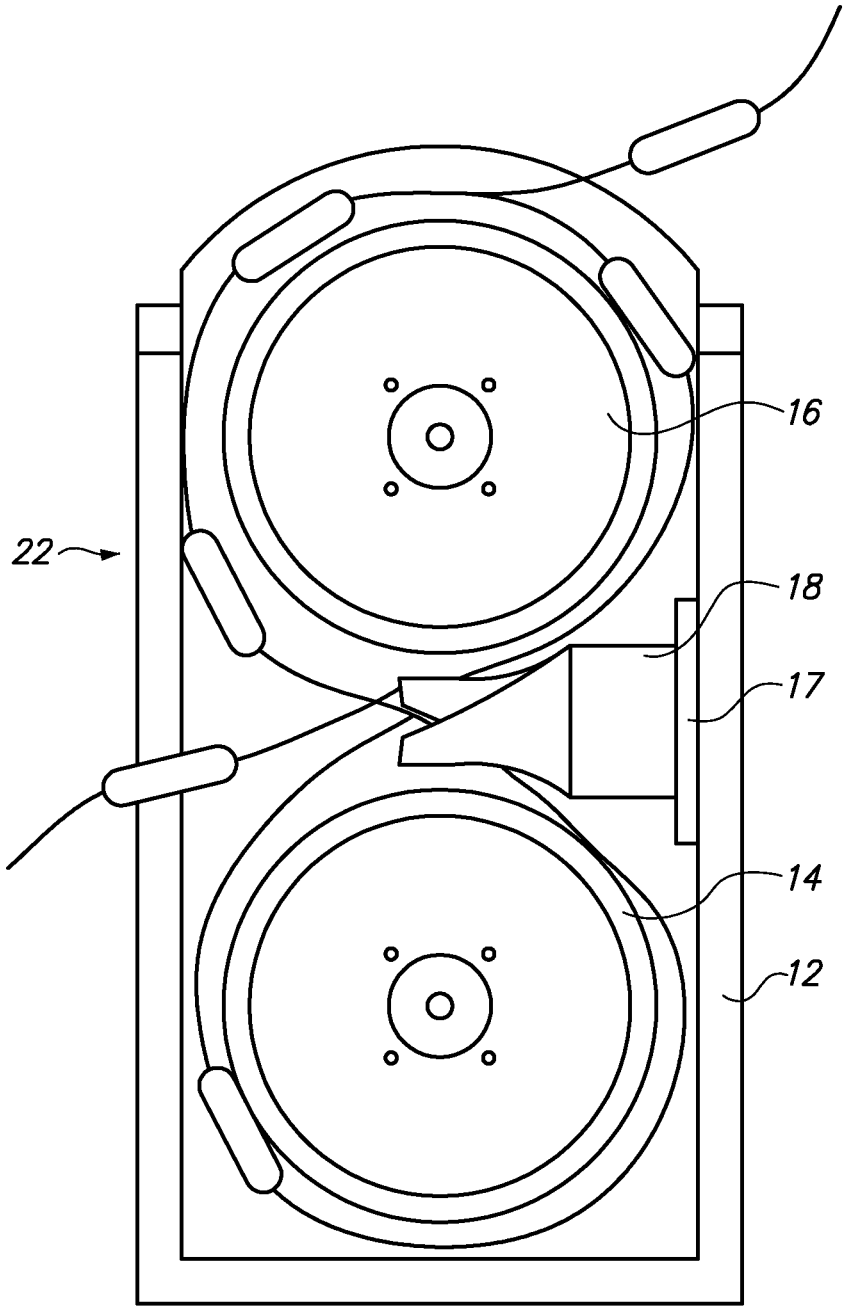
FIG. 4 is a plan view of the winch of FIG. 1, but with an array cable threaded through the winch for deployment/recovery.

The methods according to several embodiments can further include the step of threading the cable around first drum 14, through guide vanes 18 and around second drum 16 in a figure-eight configuration, as indicated by block 708 and as shown in FIGS. 4 and 5. Once the cable is threaded therethrough, the methods can also include the step of contra-rotating drum 14 and 16, indicated by block 710 in FIG. 6. To maintain a constant tension on the cable 22, the methods can further include the step of selectively varying the contra-rotation of the drums 14, 16, in a manner that maintains constant rotational torque on drums 14 and 16 as the ships rolls and pitches during deployment/recovery of the cable 22, and denoted by block 712 of FIG. 6. Maintaining a constant rotational torque on the drums by selective contra-rotation as shown by step 712 facilitates maintaining a constant tension on cable 22, which further facilitates deployment/recovery with a minimum of damage to cable 22.

The use of the terms "a" and "an" and "the" and similar references in the context of describing the invention (especially in the context of the following claims) is to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of any ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. A winch for recovering an underwater cable, comprising:

a first drum having a smooth surface and also being mounted on a frame;

a second drum having a smooth surface and also being mounted on said frame so that said second drum contra-rotates with said first drum, so that at least one revolution of said underwater cable is around said first drum and said second drum during operation of said winch;

a plurality of guide vanes being non-movably mounted on said frame, external to said first drum and said second drum, positioned between said first drum and said second drum , and stationary relative to said first drum and said second drum;

each said guide vane having a distal lip that extends outwardly from said guide vane, and, whereby each adjacent said distal lip extends in opposite directions when viewed in top plan.

2. The winch of claim 1 wherein each guide vane has a base and a decreasing taper from a maximum width at said base to a minimum width at said distal lip.

3. The winch of claim 2 wherein said first drum and said second drum have a respective first engagement surface and a second engagement surfaces, wherein said first drum and said second drum have respective first and second curvatures, and wherein said guide vanes are stacked on top of each other so that said leading edge of one of two immediately adjacent said guide vanes conforms to said first curvature said first engagement surface, and said leading edge of the other of said immediately adjacent guide vanes conforms to said second curvature of said second engagement surface.

4. The winch of claim 2 wherein said guide vanes are formed with a profile having a decreasing thickness, from a maximum thickness at said base to a minimum thickness proximate said distal lip.

5. The winch of claim 1 further comprising a hydraulic control circuit connected to said first drum and said second drum to selectively vary said rotational torque of said first drum and said second drum.

6. A method for deploying and recovering cable from a ship, said method comprising the steps of:

A) attaching a frame to said ship;

B) mounting a first drum having a smooth first surface and a second drum also having a smooth second surface on said frame;

C) non-movably fixing a plurality of guide vanes on said frame between said first drum and said second drum so that said plurality of guide vanes are stationary relative to said first drum and said second drum, each said guide vane being external to and spaced apart from said first surface and said second surface, and each said guide vane further having a base and a distal lip that extends outwardly from said guide vane;

said step C) being accomplished so that each adjacent said distal lip extends in opposite directions when viewed in top plan;

D) threading said cable around said first drum, through said guide vanes and around said second drum in a figure eight configuration; and, E) contrarotating said first drum and said second drum.

7. The method of claim 6 wherein said step C) is accomplished with guide vanes that have a decreasing taper, from a maximum width at said base to a minimum width at said distal lip.

8. The method of claim 7 wherein said step C) is accomplished by stacking said guide vanes on top of each other.

9. The method of claim 8 said step C) is further accomplished so that one of said leading edges of two immediately adjacent guide vanes conforms to said first engagement surface and the other said leading edge of said immediately adjacent guide vanes conforms to said second engagement surface.

10. The methods of claim 6 further wherein said step E) is accomplished by a motor attached to said first drum and said second drum, and further comprising the steps of:

F) selectively varying said contra-rotation to maintain a constant tension on said cable.

* * * * *